US012251610B2

(12) United States Patent
Rocco

(10) Patent No.: US 12,251,610 B2
(45) Date of Patent: Mar. 18, 2025

(54) BALL SWING TRAINING SYSTEM

(71) Applicant: Stephen Rocco, Pond Eddy, NY (US)

(72) Inventor: Stephen Rocco, Pond Eddy, NY (US)

( * ) Notice: Subject to any disclaimer, the term of this patent is extended or adjusted under 35 U.S.C. 154(b) by 238 days.

(21) Appl. No.: 17/715,565

(22) Filed: Apr. 7, 2022

(65) Prior Publication Data

US 2022/0323841 A1 Oct. 13, 2022

Related U.S. Application Data

(60) Provisional application No. 63/171,617, filed on Apr. 7, 2021.

(51) Int. Cl.
*A63B 69/00* (2006.01)

(52) U.S. Cl.
CPC .. *A63B 69/0002* (2013.01); *A63B 2069/0008* (2013.01); *A63B 2220/833* (2013.01); *A63B 2225/093* (2013.01)

(58) Field of Classification Search
CPC ..... A63B 69/0002; A63B 69/0008; A63B 2069/0008
USPC ..... 473/457
See application file for complete search history.

(56) References Cited

U.S. PATENT DOCUMENTS 5,711,726 A * 1/1998 Powers ..... A63B 69/0002 473/453
7,300,365 B2 * 11/2007 Taylor ..... A63B 69/0002 473/422
10,245,493 B2 * 4/2019 Beedle ..... A63B 69/0075
10,441,865 B2 * 10/2019 Direnzo ..... A63B 69/0075
2003/0220177 A1 * 11/2003 Orlando ..... A63B 69/0057 482/148
2008/0102992 A1 * 5/2008 Novosel ..... A63B 69/385 473/425
2013/0296080 A1 * 11/2013 Sofka ..... A63B 63/06 473/453
2014/0121039 A1 * 5/2014 Robinson ..... A63B 69/0079 473/423
2020/0238146 A1 * 7/2020 Taulelle ..... A63B 69/0002
2022/0323841 A1 * 10/2022 Rocco ..... A63B 69/0002

* cited by examiner

*Primary Examiner* — Mitra Aryanpour
(74) *Attorney, Agent, or Firm* — John Rizvi; John Rizvi, P.A.—The Patent Professor®

(57) ABSTRACT

A ball swing training system includes a training device having a swing assembly carried by a support assembly. The swing assembly may include a bracket, which may be C-shaped, carrying one or more pairs of elastically deformable, resistance pads. The pads may be elastically biased to a rest position in which the pads are oriented towards one another with respective front sides of the pads providing a striking surface. From the rest position, the pads may be elastically deformed by a hand-operated bat impacting the striking surface. The pads are configured to absorb part of the mechanical energy of the impacting bat, and to deform sufficiently away from one another to allow the bat to pass through. The system allows to develop proper swing mechanics for swinging in different strike zone quadrants, launch angles, planes, and directions, these multiple adjustments usable simultaneously.

21 Claims, 10 Drawing Sheets

BALL SWING TRAINING SYSTEM

CROSS-REFERENCE TO RELATED APPLICATIONS

This application claims the benefit of U.S. Provisional Patent Application No. 63/171,617, filed on Apr. 7, 2021, which is incorporated by reference herein in its entirety.

FIELD OF THE INVENTION

The present invention is directed to a baseball, softball, or other similar ball swing training system. More particularly, the present invention is directed to a ball swing training system that assists in developing proper swing mechanics by allowing a batter to impact, and swing through, a plurality of flexible resistance pads, which are supported by a multi-directionally adjustable support and orientable in a variety of directions, planes, and angles to carry out a variety of different swing training exercises, wherein the various adjustments are available simultaneously.

BACKGROUND OF THE INVENTION

In the game of baseball, it is known that hitting a ball is very challenging and dynamic. As a matter of fact, many sports writers, coaches, and athletes are of the belief that hitting a baseball is the most challenging thing to do in all of sports. The batter has to make contact with pitches, thrown from pitchers, coming to them with change of speed and location while the ball could be curving, sinking, rising within all areas of the strike zone, or outside the strike zone. While this is happening the batter has four one hundredth of a second to decide to swing or not. Difficulty is further increased by having to hit a round-shaped ball with a rounded, generally cylindrical bat.

In this dynamic venture, a popular theory establishes that the player must hit the ball square while attempting to match the pitch angle for the greatest advantage of physics (this is known as "barreling up", or appropriately combining force and launch angle). In addition, the player must hit the ball into fair play while trying to hit the ball on the appropriate launch angle to guarantee the greatest distance, in an attempt to hit the ball over the fence, also known as hitting a home run, the ultimate feat at every player at bat. To further increase difficulty, these various criteria and calculations during a swing must be carried out virtually unconsciously. Hall of Fame player Yogi Berra was quoted "you can't hit and think at the same time".

Furthermore, similarly to a fingerprint, no two players have the same exact swing, but only similar. Each person is inherently different, and every player must find, based upon their anatomy, natural set of skills, and genetic makeup, their own unique swing based upon their unique attributes to the slightest degree of measure. Batting is an art of the slightest measurements; a fraction off, and a batter can turn a fair ball into a foul, or a home run into a routine fly ball out. Therefore, bat swinging is not only a dynamic art, but also highly dependent on each player's characteristics.

Devices for developing baseball swings are known in the art. Most common is a baseball tee having a base, a shaft that extends vertically from the base, and a support connected to the top of the shaft to receive and support a ball, for the batter to swing and hit the ball, ejecting the ball from the support. However, these batting tees encourage poor and/or unrealistic swing mechanics. For example, because the ball sits on top of the tee, a proper swing, where the ball is struck on a lower portion, is impeded by the bat making contact with the shaft or support on which the ball is supported. Furthermore, since the ball is statically held by the support, the ball offers less resistance to the swing relative to batting a thrown ball, where the thrown ball making contact with the bat exerts a force on the bat which provides a resistance to the swing.

Alternative devices are known in which the ball is instead held from above. However, these devices also fail to encourage proper and realistic swing mechanics. For example, in order to hold the ball, the device has a retaining member that covers at least half the ball, restricting visibility of the upper portion of the ball. A further alternative device is known, which uses vacuum pressure to move the ball through a hitting zone to develop hand eye coordination and not swing mechanics. This alternative device is therefore not helpful in training actual swing mechanics.

Accordingly, there is an established need for a baseball swing training solution that solves at least one of the aforementioned problems. For example, there is a need for a ball swing training solution that allows the trainee to develop muscle training and muscle memory for proper swing mechanics, through repetitive use of the device, without the need for another person, and without having to hit and chase a ball.

SUMMARY OF THE INVENTION

The present invention is directed to a baseball, softball, or other ball swing training system that encourages proper swing mechanics in multiple directions, quadrants, planes, or angles, wherein these multiple swinging features may be adjusted and trained simultaneously. Through repetition and without requiring chasing or repositioning a ball, or help of another person, a user of the training system may develop muscle training and muscle memory for proper swing mechanics, so that the user may rapidly and unconsciously execute proper swing mechanics in real life batting conditions (when swinging a thrown ball). The training system promotes strengthening and proper swing mechanics, for instance, by providing initial and partial resistance upon swinging on a striking surface of the system, and then allowing the batter to swing through the system and complete a full swing. In some embodiments, the amount of resistance for completing a full swing may be adjustable. The training system may be used both indoors and outdoors, enabling indoor training in the event of unfavorable weather or climate conditions. In some embodiments, the training system may include sensors configured to collect information regarding each swing, and/or video cameras configured to capture video images of each swing. The information and video images may be viewed, processed, stored and/or transmitted to an external device, server, network, etc. for further storage, processing, analysis and/or visualization.

In a first implementation, a ball swing training system may include a ball swing training device. The training device may include a support assembly and a swing assembly carried by the support assembly. The swing assembly may include a bracket, which may have a first member and a second member arranged in spaced-apart relationship with one another. The bracket may further include an open, first end defined between respective ends of the first and second members. A second end of the bracket opposite the first end may be connected to the support assembly. The swing assembly may further include at least one pair of resistance pads. Each pair of resistance pads may include elastically deformable, first and second pads. The first and second pads may be mountable to the first and second members of the bracket, respectively. With the first and second pads when mounted on the first and second members, the first and second pads may be elastically biased to a rest position in which the first and second pads are oriented towards one another with respective front sides of the first and second pads providing a striking surface. From the rest position, the first and second pads may be elastically deformable by a hand-operated bat impacting the striking surface. The first and second pads are configured to absorb part of a mechanical energy of the bat when the bat impacts the striking surface and to deform away from one another allowing the bat to pass through the first and second pads. Furthermore, the support assembly may be adjustable for repositioning the swing assembly along one or more directions.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention is directed to a baseball swing training system that assists in developing proper swing mechanics by allowing a batter to impact, and swing through, a plurality of flexible pads. The plurality of pads is supported by a multi-directionally adjustable support and orientable in a variety of directions, planes, and angles to carry out a variety of different swing training exercises. These multiple adjustable features may be adjusted and trained simultaneously.

Figure 1:
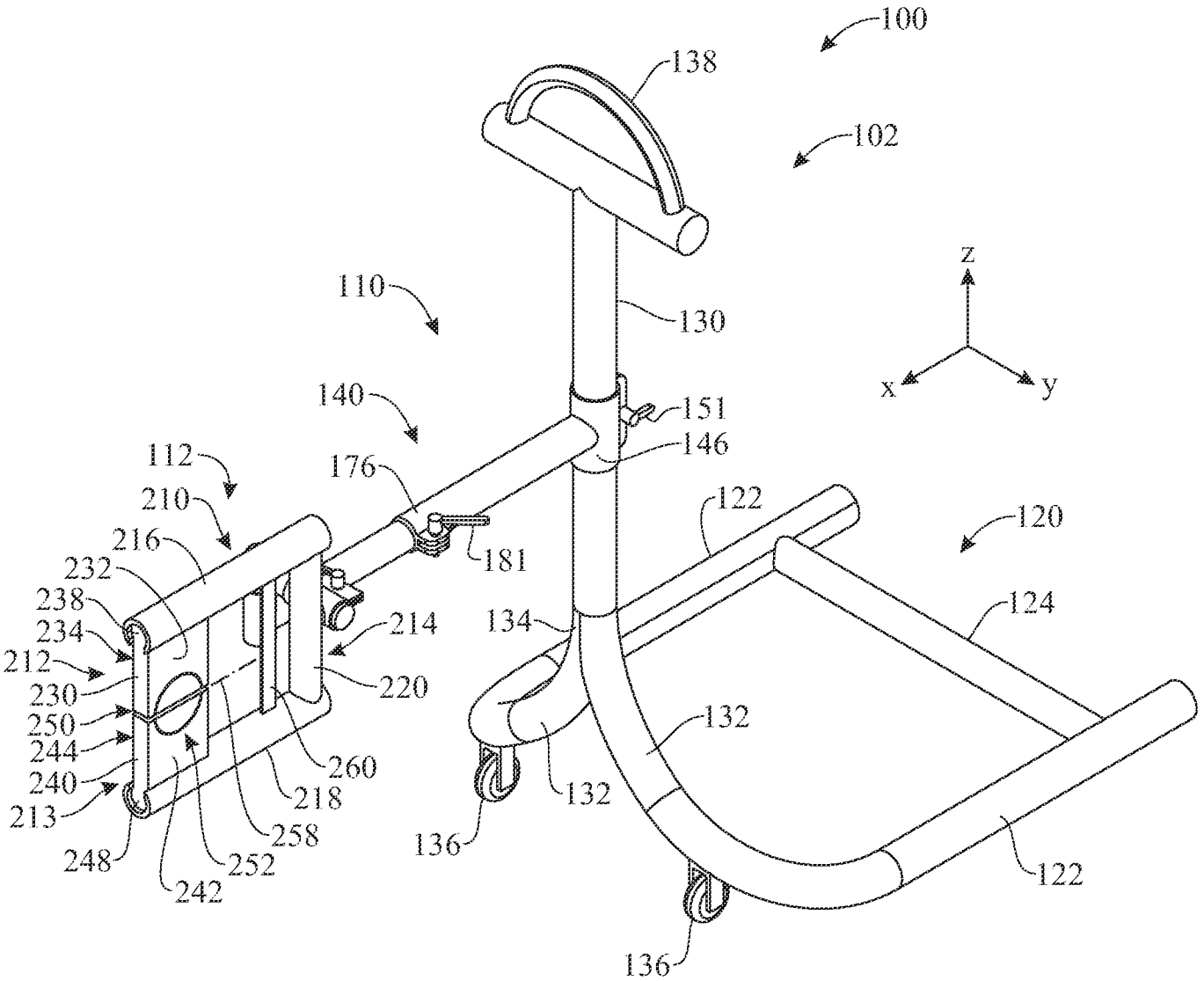
FIG. 1 presents a top, front perspective view of a training device of a training system in accordance with an illustrative embodiment of the invention.

Shown throughout the figures is a baseball, softball, or other ball swing training system 100, hereinafter referred to as training system 100, in accordance with an illustrative embodiment of the invention. Referring initially to FIG. 1, the training system 100 comprises a training device 102, which includes a support 110 and a swing assembly 112 carried by the support 110. The swing assembly 112 is configured for the impacting thereon, and swinging therethrough, of a bat or other ball hitting implement, hereinafter referred to generally as bat (e.g., bat 300 shown in FIG. 4). The support 110, in turn, is configured to carry and position the swing assembly 112 in adjustable heights and orientations, to accommodate to a variety of user heights and swing types, as will be described hereinafter. In different embodiments of the invention, the support may be configured to rest on the ground or another horizontal or sloped surface, and/or to attach to a support structure such as a wall, beam, vertical post, tree, etc. For example, the support 110 may be configured to attach to any 3-to-4-inch vertical post for operation; for example, support 110 may be attached to a metal fence post such as the metal posts that form a baseball backstop.

In the non-limiting example shown in the drawings, the support 110 includes a base 120 for resting on the ground. The base 120 may include at least one elongated, generally horizontal member or foot 122, and at least one elongated, generally horizontal member or cross beam 124 extending at an angle from the at least one foot 122, providing increased stability and/or reinforcement. For example, the base 120 shown herein specifically includes a pair of feet 122 arranged in spaced-apart relationship with one another, and a single cross beam 124 extending between the feet 122 at or near a free end thereof. The pair of feet 122 of the present embodiment are parallel to one another; however, alternative embodiments are contemplated in which the feet 122 may be arranged at an angle or V-shape configuration relative to each other. Alternatively or additionally, the base may be formed as a panel, block, ring, or other configuration providing lateral stability to the training device.

The support 110 may further include a post 130 extending upward from the base 120. For example, the base 120 of the present embodiment includes a pair of connecting portions 132, extending upward from the feet 122, towards one another, with the connecting portions 132 meeting at junction portion 134. The post 130 extends upward from the junction portion 134 such that the post 130 and the connecting portions 132 form an inverted-Y-shaped configuration. In some embodiments, the post 130 may be permanently attached to the base 120. For instance, some or all of the post 130, junction portion 134, connecting portions 132, feet 122, and cross beam 124 may be permanently attached to one another, such as by welding, or may be integrally formed into a single-piece unit. In other embodiments, one or more of the post 130, junction portion 134, connecting portions 132, feet 122, and cross beam 124 may be disconnectably attached to each other, such as by a threaded connection or frictional fitting, and may be disconnected from one another for storage or transportation purposes.

In some embodiments, such as the present embodiment, the post 130 may extend upward in a generally vertical direction z. In other embodiments, the post 130 may be tilted or arranged at an angle other than 90 degrees with the base 120; in a non-limiting example, the post 130 may be sloped towards the base 120 forming an angle of 85 degrees with the base 120. Further embodiments are contemplated in which the post 130 may be selectively adjusted to different angles relative to the base 120.

In an illustrative embodiment in which the base (for example, base 120) is configured to rest on the ground, the base may weigh between 50-70 pounds, allowing to counteract hitting forces and maintain the training device in the upright position during use. In some embodiments, the base may include one or more weighted elements or weights, configured to provide the selected weight. In some embodiments, the weight(s) may be integrally formed with or permanently attached to the base 120; for example, the feet 122 and/or cross beam 124 may contain relatively-high density components (e.g., sand, concrete, etc.) providing increased weight. Alternatively or additionally, one or more weights may be removably attached to the base 120. A user may select a total extra weight imparted to the base 120 by selectively mounting a number of weights and/or one or more weights of selected mass, to customize the total weight of the base 120 as desired. When not in use, the removable weight or weights may be removed from the base 120, such as for storage or transportation purposes.

With continued reference to FIG. 1, the training device 102 may include one or more rollers, casters, or wheels 136 providing rolling mobility along the ground or surface on which the base 120 stands. In some embodiments, the training device 102 may include a gripping portion or handle 138 to facilitate rolling and maneuvering the training device 102 along the ground. The present embodiment, for instance, specifically includes wheels 136 at a front end of the base 120 and in vertical alignment with the post 130 and further in vertical alignment with the handle 138, which is arranged at a top end of the post 130. Such configuration enables easy and convenient transportation of the training device 102 by holding the handle 138, tilting the device forward to lift the feet 122 off the ground, and rolling the training device 102 along the ground by pushing, pulling and/or turning the handle 138.

With continued reference to FIG. 1, the support 110 may further include an arm assembly 140 extending between the post 130 and the swing assembly 112. The arm assembly 140 may be carried by and extend from the post 130. The swing assembly 112, in turn, may be carried by the arm assembly 140. In some embodiments, the arm assembly 140 may be height-adjustably carried by the post 130, such that the height of the arm assembly 140 relative to the ground is adjustable by varying the position of the arm assembly 140 along the post 130. Alternatively or additionally, the arm assembly 140 may be rotatable about the post 130, i.e. relative to a rotation axis 142, parallel to or provided at a central longitudinal axis of the post 130. It should be noted that the arm assembly 140 may also be connected to an existing post, such as a metal fence post such as the metal posts that form a baseball backstop, alternatively to the post 130 and base 120.

Figure 2:
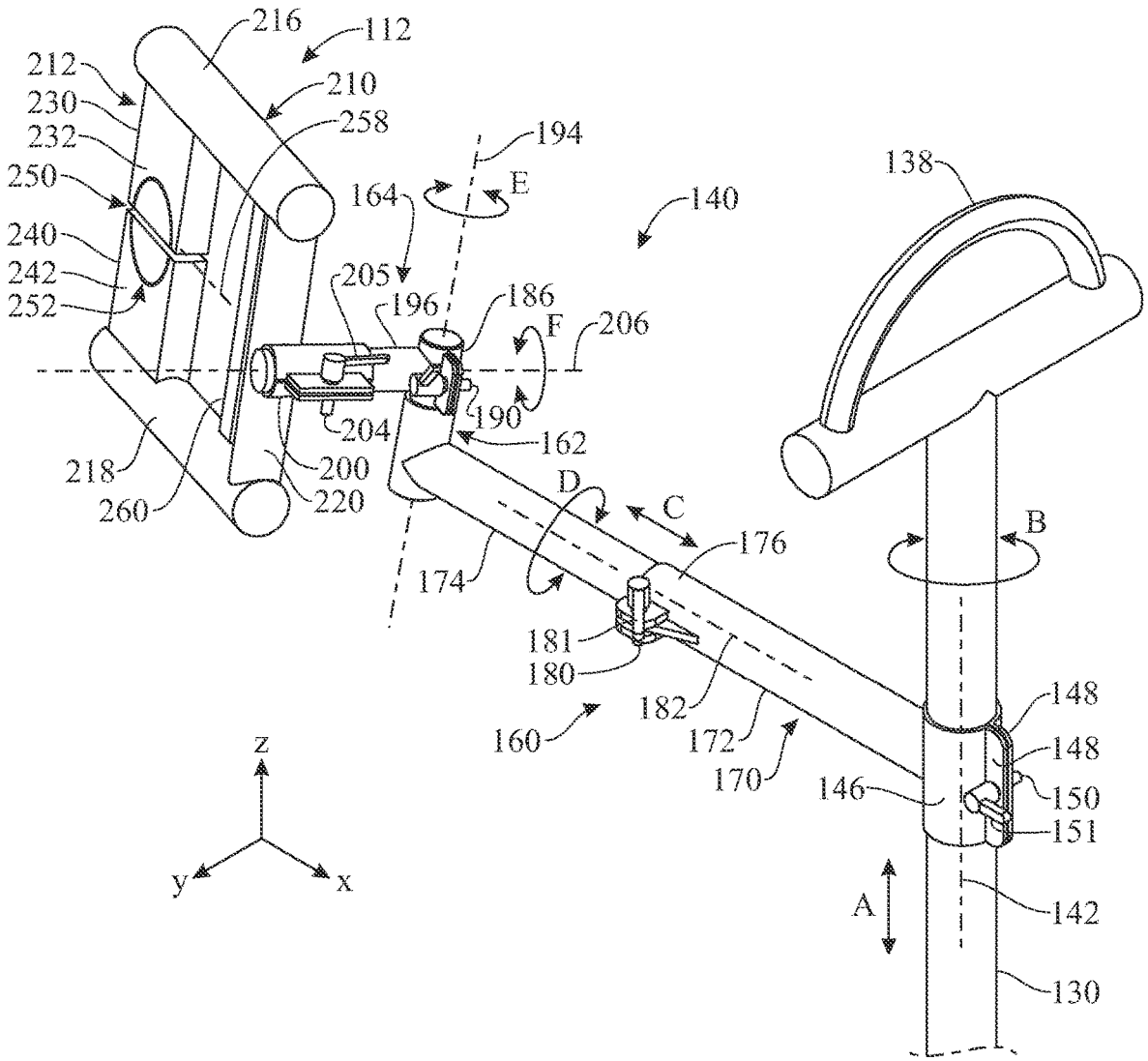
FIG. 2 presents a partial, top front perspective view of a post, arm assembly, and swing assembly of the training device of FIG. 1.
Figure 3:
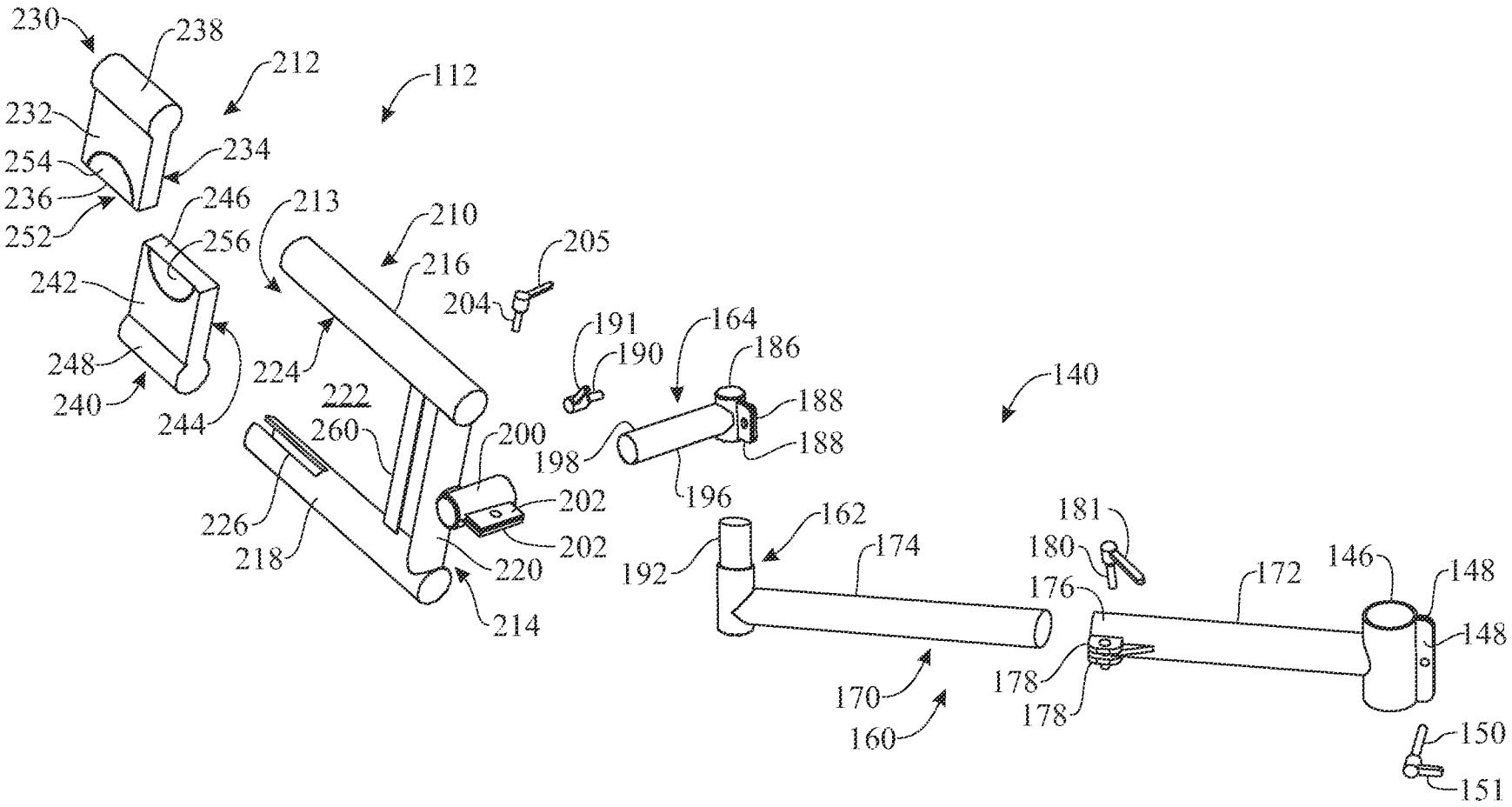
FIG. 3 presents an exploded, top front perspective view of the arm assembly and swing assembly of the training device of FIG. 1.

For example, the arm assembly 140 of the present embodiment is specifically connected to the post 130 by a first clamp 146, which is slidably mounted over and to the post 130. As best shown in FIGS. 2 and 3, the first clamp 146 may be formed as an elastically flexible, split sleeve, generally shaped and sized to conform to the outer contour of the post 130; for example, the first clamp 146 and post 130 may be generally cylindrical, as shown. A pair of flanges 148 may extend from opposite ends of the split cylinder, first clamp 146, in spaced-apart configuration with one another. A fastener 150, such as a threaded bolt, may engage the spaced-apart flanges 148 allowing to selectively bring the flanges 148 closer to or farther from each other to tighten or loosen the first clamp 146, respectively, relative to the post 130. A fastener knob or handle 151 may be operatively coupled to the fastener 150, facilitating manual operation of the fastener 150. When loosening the first clamp 146 relative to the post 130, the first clamp 146 is allowed to slide along the post 130 as indicated by arrow A. In some embodiments, the post 130 may include visual markings to indicate different height adjustments of the swing assembly 112 (via the arm assembly 140) along arrow A. Alternatively or additionally, the post 130 may include a plurality of discrete, spaced-apart holes at different heights, for the insertion of a pin to selectively adjust the arm assembly 140 at the discrete positions. Furthermore, in the present embodiment, in which both the first clamp 146 and the post 130 are cylindrical, when loosened, the first clamp 146 is further allowed rotate to relative to the post 130 about the rotation axis 142, as indicated by arrow B. It should be noted that the rotation axis 142 of the present embodiment is generally vertical, and thus rotation of the arm assembly 140 about rotation axis 142 takes place on a generally horizontal or x-y plane.

The arm assembly 140 may be adjustable to vary a distance between the swing assembly 112 and the support 110, such as, but not limited to, a distance between the swing assembly 112 and the post 130. For example, in some embodiments, such as the present embodiment, such adjustment is provided by the arm assembly 140 being length-adjustable. Alternatively or additionally, the arm assembly 140 may be adjustable such that the swing assembly 112 carried thereon is selectively orientable in multiple directions and planes relative to the ground (and thus to the user). In the non-limiting example shown in the drawings, the arm assembly 140 is allows for all said adjustments simultaneously; however, alternative embodiments are contemplated without departing from the scope of the present disclosure.

With continued reference to FIGS. 2 and 3, the arm assembly 140 may include a plurality of segments, such as, but not limited to, a first segment 160, a second segment 162 and a third segment 163. The first segment 160 may extend from the post 130, and may include an elongate body 170. A first end of the elongate body 170 may be affixed to and extend from the first clamp 146. An opposite, second end of the elongate body 170 may be affixed to the second segment 162. In some embodiments, such as the present embodiment, the elongate body 170 may be length-adjustable. For instance, the elongate body 170 may include elongate, first and second portions 172 and 174, which may be telescopically connected to one another. A second clamp 176 may be provided at the hollow or female one of the telescopic, first and second portions (e.g., first portion 172). The second clamp 176 may be constructed as a split termination of said hollow or female one of the first and second portions 172 and 174. A pair of spaced-apart flanges 178 may extend from the second clamp 176, and a fastener 180 may thread through or otherwise adjustably connect the flanges 178 to one another to selectively tighten or loosen the second clamp 176 against the other of the first and second portions 172 and 174 (e.g., the second portion 174). A fastener handle 181 may be operatively coupled to the fastener 180, facilitating manual operation of the fastener 180. When loosening the second clamp 176, the second portion 174 is allowed to slide along the first portion 172, as indicated by arrow C; in addition, in the present embodiment, in which the first and second portions 172 and 174 are cylindrical, the second portion 174 is allowed to rotate relative to, and within, the first portion 172, about a rotation axis 182 arranged along a central longitudinal axis of the first and second portions 172, 174. The elongate body 170, length-adjustment direction (arrow C) and rotation axis 182 may be arranged generally perpendicular to the vertical direction z and to the post 130, i.e. may be arranged on a horizontal or x-y plane, as shown.

As best shown in FIG. 3, the second segment 162 may extend perpendicularly from the first segment 160, such as in an L-shaped or T-shaped arrangement. Thus, by means of the rotatable articulation provided by the second clamp 176 about horizontal rotation axis 182, the second segment 162 may rotate on different vertical planes; it should be noted that, as the arm assembly 140 rotates about the post 130, said vertical planes do not intersect with the vertical, central longitudinal axis of the post 130 and revolve around the rotation axis 142. The third segment 164 may be formed as an elongate body extending from the second segment 162. In some embodiments, as shown, the third segment 164 may be pivotably connected to the second segment 162, such as by a third clamp 186. The third clamp 186 may be provided at one of the second and third segments 162 and 164 (e.g., the third segment 164), and may pivotably connect to an end portion 192 of the other of the second and third segments 162 and 164 (e.g., the second segment 162). The third clamp 186 may be constructed as a split, cylindrical sleeve, and a pair of spaced-apart flanges 188 may extend from the third clamp 186. A fastener 190 may thread through or otherwise adjustably connect the flanges 188 closer or farther to one another to selectively tighten or loosen the third clamp 186 against the other of the second and third segments 162 and 164 (e.g., the end portion 192 of the second segment 162). A fastener handle 191 may be operatively coupled to the fastener 190, facilitating manual operation of the fastener 190. As best shown in FIG. 2, when loosening the third clamp 186, the third segment 164 is allowed to rotate relative to the second segment 162 about a rotation axis 194 as indicated by arrow E. The rotation axis is arranged on the same vertical plane as the second segment 162.

With continued reference to FIGS. 2 and 3, the third segment 164 may include an elongate body 196, which is perpendicular to the second segment 162 and extends from the third clamp 186. A fourth clamp 200 may pivotably interconnect the third segment 164 to the swing assembly 112. More specifically, the fourth clamp 200 may be provided at or comprised in one of the third segment 164 and swing assembly 112 (e.g., the swing assembly 112, as shown herein), and may adjustably connect to the other of the third segment 164 and swing assembly 112 (e.g., to an end portion 198 of the elongate body 196 of the third segment 164). Similarly to the previous clamps, the fourth clamp 200 may be constructed as a split, cylindrical sleeve, and a pair of spaced-apart flanges 202 may extend from the fourth clamp 200. A fastener 204 may thread through or otherwise adjustably connect the flanges 202 closer or farther to one another to selectively tighten or loosen the fourth clamp 200 against the other of the third segment 164 and swing assembly 112 (e.g., to the end portion 198). A fastener handle 205 may be operatively coupled to the fastener 204, facilitating manual operation of the fastener 204. As best shown in FIG. 2, when loosening the fourth clamp 200, the swing assembly 112 is allowed to rotate relative to the third segment 164 about a rotation axis 206 as indicated by arrow F. Rotation axis 206 may be generally perpendicular to rotation axis 194.

In some embodiments, the training device 102 may further include visual markings at or near the different adjustment elements, i.e. at or near the first, second, third, and fourth clamps 146, 176, 186 and 200, to provide a visual reference of a rotational and/or translational adjustment provided by each clamp. In some embodiments, the markings may be unrelated to each other. For example, each clamp 146, 176, 186, and 200 may include visual markings indicating different rotational adjustment angles and/or translational adjustment depths, when applicable, assisting with creating and remembering different adjustments or settings. In other embodiments, the markings may be related to each other. For example, the markings may be grouped between clamps, facilitate simultaneous and related adjustment of all clamps to provide a certain joint effect (e.g., a specific training program). In a non-limiting example, training programs "Q1" to "Q9" may be provided to practice training on nine different swing zones or quadrants, described in more detail hereinafter; each clamp may include nine different adjustment markings marked as "Q1" through "Q9", such that adjusting all clamps to "Q1" positions the training device in an overall position configured to train swinging towards a ball pitched in the first quadrant, while adjusting all clamps to "Q2" instead allows to position the device to train swinging towards a ball pitched in the second quadrant, and so forth.

As noted hereinabove, the fasteners 150, 180, 190 and 204 described herein may include, for instance and without limitation, a threaded bolt. However, alternative embodiments are contemplated without departing from the scope of the present invention. For instance, any one of the fasteners may include a quick-connect fastener, a quick-release fastener, a push-push fastener, a push-pull fastener, a bayonet fastener, a frictional fitting, etc., which allows to selectively release and secure the respective clamp, without departing from the scope of the present disclosure.

It should be noted that other manually-operable adjustment means may be provided alternatively or additionally to the aforementioned manually operated split-sleeve clamps, such as, but not limited to, cotter pins, spring-loaded pins, notch and grooves, etc. The different rotational and translational movements described heretofore provide a manual adjustment between generally rigid components. Such manual adjustment of interconnected rigid components provides an easy to use, cost effective, and yet extremely versatile and omni-directionally adjustable training device. Notwithstanding, alternative embodiments are contemplated in which one or more of the aforementioned rotational and/or translational movements may be automatic, such as hydraulically-, pneumatically- or electrically-driven (for example, using DC and/or stepper motors). It should further be noted that the articulated and translational movements described heretofore may be instead or additionally facilitated by mechanisms such as a piston, a ball joint, a universal joint, a gooseneck, etc., without departing from the scope of the present disclosure.

The illustrations of FIGS. 1-3 further show the swing assembly 112, which, as described heretofore, is carried by the arm assembly 140 and configured to be impacted by a bat or other hitting implement during training. The swing assembly 112 may include a bracket 210 carrying a plurality of elastically deformable pads 212. In non-limiting examples, the plurality of pads 212 may be made of relatively dense foam, rubber (e.g., EPDM rubber), neoprene, silicone, polyurethane, or combinations thereof. In one non-limiting example, the pads 212 may be made of neoprene having a hardness of between 20 and 90 (Shore A), and in a more specific example, of about 60. In some embodiments, such as the present embodiment, the bracket 210 may be generally rigid or undeformable. In some embodiments, the resistance offered by the pads 212 may be homogeneous or uniform along each pad 212; in other embodiments, the pad 212 may offer a non-uniform resistance (e.g., hardness) along the pad 212. The bracket 210 may have a C-shaped, U-shaped, or other configuration such that the bracket 210 comprises an open side 213 and a closed side 214. For example, the bracket 210 may include first and second elongate bodies or members 216 and 218, respectively, which are spaced-apart and generally parallel to one another and rigidly extend from an elongate, connecting member 218 such that the first, second and connecting members 216, 218, 220 form a C-shaped arrangement. Alternative constructions are contemplated, however, in which the C-shape or U-shape may present alternative shapes, such as curved, oval, etc., and/or relatively more or less elongated than the C-shape or U-shape depicted herein. The bracket 210 may be manufactured of metal, wood, plastic, or other materials or combinations thereof suitable to absorb impact forces transferred onto the bracket 210 during operation of the training system 100.

As shown for instance in FIG. 1, the bracket 210 defines a space 222 between the first and second members 216, 218. The plurality of pads 212 are carried by the bracket 210 and extend into and within the space 222. In some embodiments, such as the present embodiment, the plurality of pads 212 may include a pair of pads comprising a first pad 230 and a second pad 240 arranged in opposing relationship with each other, with the first pad 230 carried by the first member 216 and the second pad 240 carried by the second member 218 of the bracket 210. In other embodiments, the plurality of pads may include additional pairs of pads, each pair of pads similarly comprised of a first pad and a second pad carried by the first and second members of the bracket, respectively. With reference to the pair of pads 230, 240 shown in the drawings, and applicable to other pairs of pads if present, the first and second pads 230 and 240 may be arranged facing and opposite to one another and are generally shaped as a panel or block. A front, first side 232 of the first pad 230 may be generally coplanar with a front, first side 242 of the second pad 240. Alternatively or additionally, and preferably additionally, a rear, second side 234 of the first pad 230 may be generally coplanar with a rear, second side 244 of the second pad 240. The pads 230, 240, are not formed in material continuity with each other; i.e. a free end 236 of the first pad 230 is not cojoined with a free end 246 of the second pad 240. The free ends 236, 246 of the first and second pads 230, 240 may be separated from each other by a space, gap or slot 250, which, in different embodiments, may not be apparent or visible, or may be visible to the user. For instance, in some embodiments, such as the present embodiment, the first and second pads 230, 240 are separated by a relatively visible slot 250. The slot 250 may be straight or flat, and arranged in a slot plane 258 which may be parallel to the first and second members 216 and 218 of the bracket 210.

In some embodiments, one or both pads 230 and 240 may be permanently attached to and carried by the bracket 210. Embodiments are also contemplated in which one or both pads 230 and 240 are disconnectably attached to the bracket 210. For instance, each pad 230, 240 of the present embodiment is disconnectably attached to the respective first or second member 216, 218 of the bracket 210. In a non-limiting example, an inner end 238 of the first pad 230 is shaped and sized to be slidably and removably received inside the first member 216, with the first pad 230 protruding outwardly through a slot 224 formed in the first member 216. The inner end 238 is wider than the slot 224, allowing the inner end 238 to remain inside, and retained within, the first member 216 while the remainder of the first pad 230 protrudes outwardly and into the space 222. Similarly, an inner end 248 of the second pad 240 is shaped and sized to be slidably and removably received inside the second member 218, with the second pad 240 protruding outwardly through a slot 226 formed in the second member 218. The inner end 248 is wider than the slot 226, allowing to retain the inner end 248 of the second pad 240 within the second member 218 while the remainder of the second pad 240 protrudes outwardly and into the space 222. Alternative embodiments are contemplated, however, regarding the connection between the pads 230, 240 and the bracket 210, without departing from the scope of the present disclosure. For instance, the pads may be connected to the bracket by clamps, fasteners or other rigid cantilever mounts, or by pivoting mounts.

As shown for instance in FIG. 2, the swing assembly 112 may further include a visual target 252 on one or both sides or striking surfaces of the pads 230, 240. For example, the embodiment depicted herein includes a single visual target 252 on the first sides 232, 242 of the pads 230, 240. In some embodiments, the visual target 252 may be generally flat or two-dimensional, such as printed, stamped or slightly engraved on the pads 230, 240. In other embodiments, the visual target 252 may be generally three-dimensional, such as visibly protruding outwardly from the pads 230, 240. In some embodiments, the visual target 252 may resemble a ball, such as, but not limited to, a baseball or softball. The visual target 252 may be divided into two or more parts, which may be a vertical mirror image one of the other in some embodiments. For example, the visual target 252 shown herein includes a first visual target portion 254 and a second visual target portion 256, which are a mirror of each other and are respectively provided on the first side 232 of the first pad 230 and the first side 242 of the second pad 240. In some embodiments, the visual target 252 may be configured to provide a different resistance to hitting than the remainder of the pads 212. For example, each one the first and second visual target portions 254 and 256 may be harder than the remainder of the respective pad 230, 240. In one non-limiting example of this, the first and second pads 230 and 240 and first and second visual target portions 254 and 256 may be manufactured from neoprene, the pads 230 and 240 having a hardness of 50 and the first and second visual target portions 254 and 256 having a hardness of 80.

Figure 4:
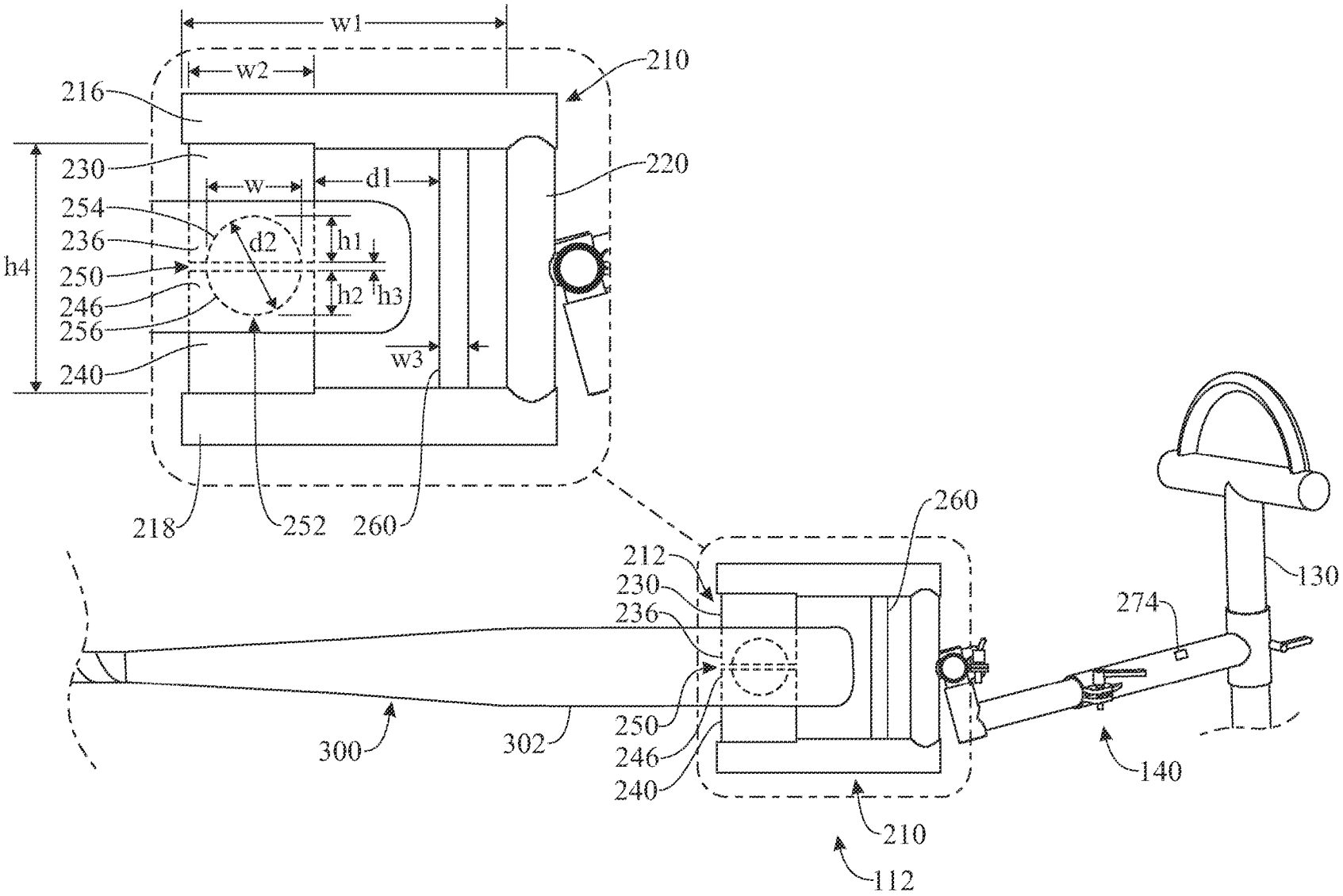
FIG. 4 presents a front elevation view of the post, arm assembly, and swing assembly of the training device of FIG. 1, with a bat shown impacting first and second pads of the swing assembly.

The first and second visual target portions 254, 256 may be shaped and sized such that, when observed together, including the slot 250 formed between the first and second pads 230, 240, an overall shape of a circle or sphere is provided, as best shown in the enlarged front elevation view portion of FIG. 4. The first and second visual target portions 254, 256 are formed as portions of said circle or sphere and have a width "w" substantially equal to one another and equal to the circle or sphere diameter; in turn, the slot 250 and first and second visual target portions 254, 256 are dimensioned such that the sum of the respective heights "h1" and "h2" of the first and second visual target portions 254, 256 and the height "h3" of the slot 250 is substantially equal to the circle diameter "d2". Further embodiments are contemplated regarding the size and shape of the visual target or targets, without departing from the scope of the present disclosure.

It should be noted that, in the present embodiment, heights "h1" and "h2" are substantially equal to one another, and the slot 250 extends through a center of the circular or spherical, overall visual target 252. Such configuration may promote batting a center of a ball to maximize energy transmission. Alternative embodiments are contemplated, however, without departing from the scope of the present disclosure. For example, the top, first visual target portion 254 could represent more than half of the overall circular or spherical visual target 252, and the lower, second visual target portion 256 could represent less than half of the visual target 252, to train batting the ball offset from the center of the ball. Furthermore, the target portions 254, 256 may be made of the same or different material than the pads 230, 240; for example, in some embodiments, the target portions 254, 256 may be made of a significantly more rigid material than the pads 230, 240, said rigid material configured, for instance, to mimic a real baseball or softball hardness.

As shown in FIGS. 1-3, the swing assembly 112 may further include a cross-member 260 located in the space 222 of the bracket 210, between the pads 230, 240 and the closed side 214. The cross-member 260 may be affixed to and extend between the first and second members 216 and 218 of the bracket 210, in spaced-apart relationship with, and optionally parallel to, the pads 230, 240 and/or the connecting member 220, and closer to the connecting member 220 than to the pads 230, 240. Preferably, the distance "d1" (FIG. 4) between the cross-member 260 and the pads 230, 240 is about 1 to 2 times the distance from the barrel tip to the "sweet spot" of the barrel, such that the cross-member 260 provides a visual limit of where to place aim the tip of the barrel and encourages the batter to hit the pads 230, 240 with the "sweet spot" of the barrel, to train hitting a ball with a maximum energy transfer to the ball. In some embodiments, the cross-member 260 may be selectively adjustable along the first and second members 216 and 218 to vary the distance "d1" (for example, an advance player may choose to reduce distance "d1", to increase difficulty in hitting the pads with the barrel's "sweet spot"). The cross-member 260 may be made of a significantly more flexible material than the pads 230, 240, such as, but not limited to, soft foam. The cross-member 260 is preferably detachably or non-permanently attached to the bracket 210, such as that a user may selectively mount the cross-member 260 to the bracket 210.

Figure 6:
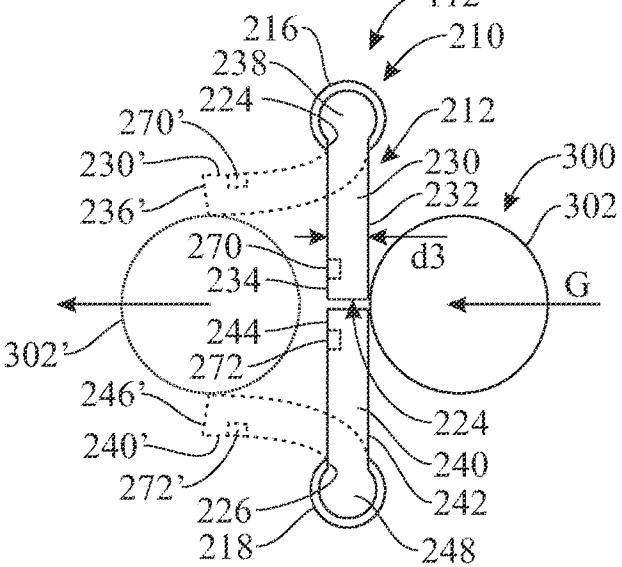
FIG. 6 presents a side elevation view of the swing assembly and bat of FIG. 4, illustrating the bat deforming and swinging through the first and second pads.

In preferred embodiments, dimensions related to the bracket 210, pads 212 and cross-member 260 may be configured in relation to dimensions of the bat and/or ball associated to the specific sports training exercise. In some embodiments, with reference to FIGS. 4 and 6, the width "w1" of the internal space 222 may be 10-12 inches. The pads 230, 240 may have a width "w2" of about 3 inches for baseball training, and about 4 inches for softball training. The cross-member 260 may have a width "w3" of about 1 inch, and may be spaced-apart from the pads 230, 240 a distance "d1" of about 5 inches, to be used with a barrel having a "sweet spot" at about 3 or 4 inches from the barrel tip, for instance and without limitation. The slot 250 may have a height "h3" of about 0.5 inches and a depth "d3" of about 1 inch, and the pads 230, 240 may have a generally constant thickness equal to "d3". In turn, the slot 250 and first and second visual target portions 254, 256 may be sized to provide an overall circular or spherical shape having a diameter "d2" of about 3 inches (corresponding to a realistic baseball), for which the respective height "h1" and "h2" of the first and second visual target portions 254 and 256 may be about 1.25 inches. In another example, the slot 250 and first and second visual target portions 254, 256 may be sized to provide an overall circular or spherical shape having a diameter "d2" of about 4 inches (corresponding to a realistic softball), for which the respective height "h1" and "h2" of the first and second visual target portions 254 and 256 may be about 1.75 inches. In other embodiments, the visual target 250 may instead be sized smaller than a standard baseball or softball (e.g., a diameter "d2" of about 1.5 to 2 inches) to promote a more focused striking on a center of a real, thrown ball. The overall separation or distance "h4" between the first and second members 216 and 218 may be 7.5-8.5 inches, for instance and without limitation.

Figure 5:
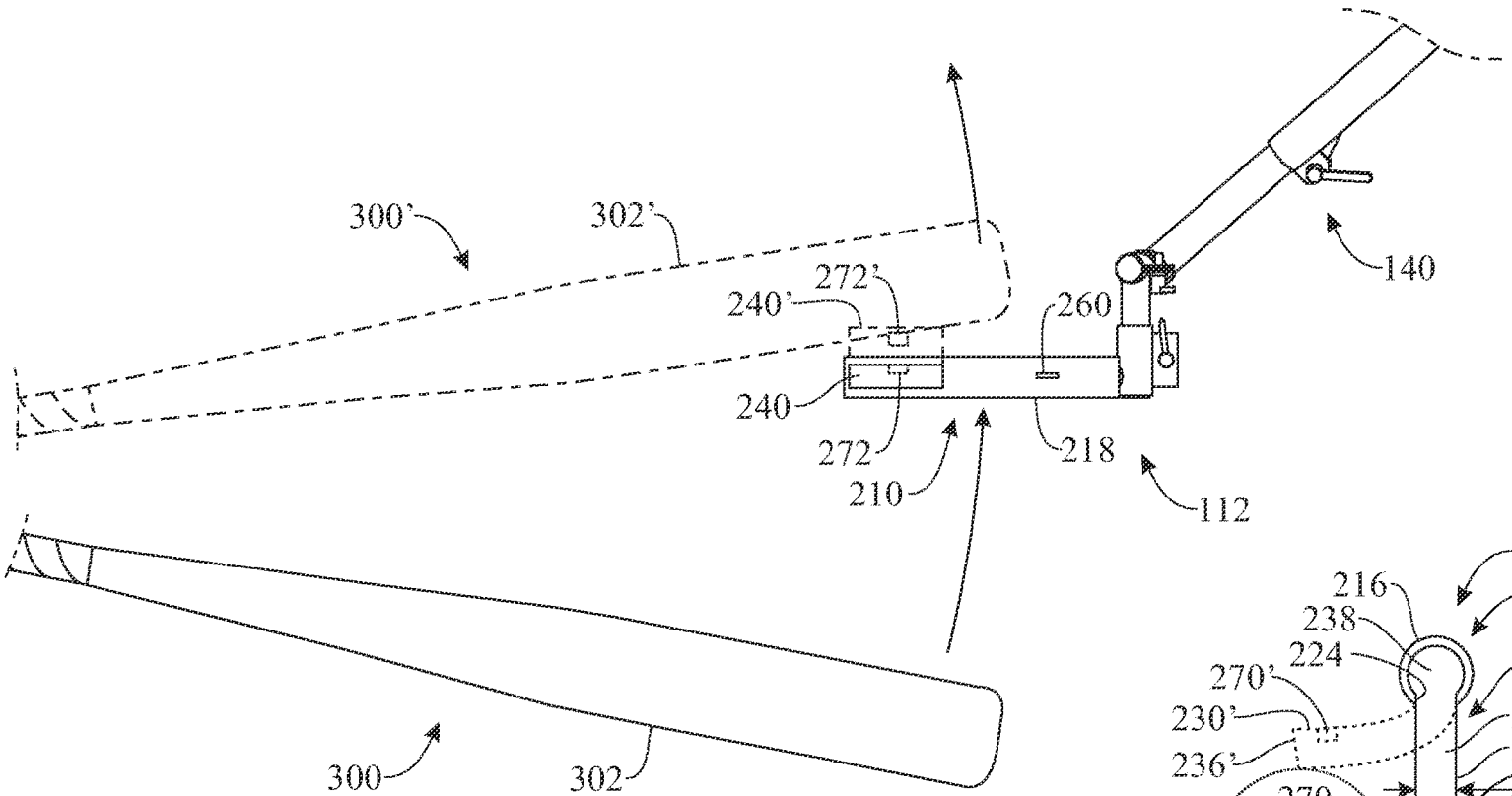
FIG. 5 presents a top plan view of the arm assembly, swing assembly, and bat of FIG. 4, with the first member and first pad of the swing assembly omitted to reveal the second member and second pad, further illustrating the bat swinging through the swing assembly and deforming the pads.

In some embodiments, the training system 100 may include one or more sensors for monitoring and/or measuring the user's training performance. For instance and without limitation, one or more sensors may be arranged on the swing assembly 112, and more preferably, on one or more of the pads comprised in the plurality of pads 212. In the non-limiting example shown in the drawings, and with reference to FIGS. 5 and 6, a respective sensor 270, 272 is provided on the first and second pads 230, 240, such as adhered to, embedded into, or otherwise carried by the pads 230, 240. In some preferred embodiments, the sensors 270, 272 may be located on the rear, second sides 234, 244 of the pads 230, 240, opposite the striking surface provided by the front or first sides 232, 242, at which the visual target 252 is be located. The one or more sensors comprised in the training system 100 (e.g., sensors 270, 272) may measure or sense a speed or force of a swing (impact of the bat against the pads 230, 240), where the bat hits the pads 230, 240, the amount of energy transferred from the bat to each one of the pads 230, 240, etc. For instance and without limitation, the sensors may include a three-axis accelerometer, and/or an Inertial Measurement Unit (IMU).

The sensors 270, 272 may be in wired or wireless signal communication with a control unit 274. Furthermore, the sensors 270, 272, control unit 274 and other electrical components of the training device 102 may be electrically powered by an internal power source (e.g., one or more rechargeable or replaceable batteries) and/or an external power source (e.g., a wall socket, generator, solar panel, etc.). In some embodiments, the control unit 274 may be located on or within the training device 102. For example, as shown in FIG. 4, the control unit 274 of the present embodiment is carried by the arm assembly 140. Alternatively, the control unit 274 may be located at other areas of the training device 102, or external to the training device 102 (for example, the control unit may be provided by a smartphone, laptop computer, or other electronic device). The control unit 274 may include one or more processors, a memory, and a wired and/or wireless communications module configured to communicate with the sensors 270, 272. The communications module may further communicate with other electronic devices. For example, the communications module of a control unit 274 located within the training device 102 may transmit data to a display located on the training device 102. In another example, the communications module of a control unit 274 located within the training device 102 may wirelessly communicate with a smartphone, router or other electronic device located near the training device 102 such as by IEEE 802.11 (Wi-Fi), Bluetooth®, or other local communication protocols. In another example, the control unit 274 located within the training device 102 may communicate with a cellular or other wide-area communications network, to transmit and/or receive data to/from a remote server or computer.

In one example, the sensors 270, 272 may sense an acceleration of the respective pads 230, 240 and transmit data related to the sensing to the control unit 274. Either the control unit 274 or an electronic device communicated with the control unit may calculate a difference in the amount of energy transferred to the upper or first pad 230 versus the lower or second pad 240 by comparing both measurements. By measuring the different amount of energy departed in the upper vs. lower pad(s), data can be determined which includes whether the swing was high or low and the estimated ball trajectory path. In another example, if the plurality of pads 212 includes two or more upper or first pads 230, and two or more lower or second pads 240 arranged in back-to-back relationship with one another, acceleration detected by a respective sensor on each back-to-back pad may allow to measure the swing depth (how shallow or deep the baseball bat swing is through the pads). In another example, a measurement field may be arranged from a series or a matrix of optical sensors and/or infrared sensors, allowing to view the impact end of the bat. These sensors may record the swing velocity, swing depth from the user, and the trajectory of the bat as it moves through the measurement field relative to the ground. The arrangement of strike pads and sensors may define the measurement field.

Alternatively or additionally to the sensors, the training system 100 may include one or more video cameras configured to record the training sessions, and store and/or transmit the recordings to another electronic device for visualization and/or analysis. For example, the cameras may transmit the recordings to the display located on the training device 102, or to a separate or remote electronic device communicating locally or remotely with the training device 102 and/or the cameras (for example, a smartphone in local communication with the cameras and the training device 102, or a server or computer in remote communication with the cameras and the training device 102). Reviewing the training session video recordings may enable or assist with studying the human body firing pattern, starting with the feet upwards and connecting to the core and continuing upwards to the upper extremities, in order to identify any energy leakage as the energy moves through the aforementioned firing pattern. The video images may allow to view the exact contact point and angles the bat barrel hit the plurality of pads 212.

In some embodiments, the training device 102 may include a plurality of pads that are interchangeably and disconnectably mountable to the bracket 210. The pads may be manufactured with different resistances to deformation, thereby providing different resistances to hitting thereon. The varying resistances offered by the selectively mountable pads may allow to reproduce different ball pitching speeds and thus varying training experiences and/or difficulty levels. Alternatively or additionally, the set of pads may include pairs of pads having a different, respective visual target on the outer or first side thereof; for instance and without limitation, a first pair of pads may include a two-dimensional baseball-sized visual target, a second pair of pads may include a two-dimensional softball-sized visual target, a third pair of pads may include a three-dimensional baseball-sized visual target, and a fourth pair of pads may include a three-dimensional softball-sized visual target, each visual target divided into mirrored or non-mirrored hemispheres, including same- or different-sized slots, including or not including sensors, including same or different sensor types and/or numbers, etc.

Operation of the training system 100 will now be described with reference to FIGS. 1, 2 and 4-11. Referring initially to FIG. 1, a coach, batter or other user may position the training device 102 at a desired location, such as by rolling the training device 102 on wheels 136 and maneuvering the handle 138 of the training device 102. The user may then manually adjust the support 110 along directions A, B, C, D, E and F, shown in FIG. 2, to adjust the height of the swing assembly 112 relative to the ground, the separation between the swing assembly 112 and the post 130, and the orientation of the swing assembly 112 as desired about one, two or all three axes or spatial directions x, y, z. Manual adjustment along said directions is carried out by operating the first, second, third and/or fourth clamps 146, 176, 186, 200 as described heretofore; as also described heretofore, in some embodiments, visual markings on the clamps may aid in adjusting all clamps to obtain a desired height and orientation of the swing assembly 112. Once the swing assembly 112 is placed at the desired height and orientation (examples of which will be described hereinafter), a batter holding a bat 300 may position him or herself near the swing assembly 112. In some embodiments, the training device 102 may be switched on, for the electrical power source to provide electrical power to the sensors 270, 272, control unit 274, and other applicable electrical components.

The batter may then swing the bat 300 onto the swing assembly 112 to perform a first swing. The swing may be carried out such that, as shown in FIG. 4, a barrel 302 of the bat 300 impacts the plurality of pads 212 at the free ends 236, 246 thereof and along the slot 250, in a direction G (FIG. 6) which is preferably flat or perpendicular to the striking surface of the pads 230, 240, i.e. to the front or first sides 232, 242 of the pads 230, 240, to promote "barreling" swing mechanics. Alternatively, the user may choose to hit slightly proportionally more on the bottom, second pad 240 than on the top, first pad 230 to practice batting at increased launch angles. The C-shaped bracket 210, and more particularly, the orientation of the first and second members 216 and 218 and the placement of the open side 213, provide a rapid visual reference as to how to orient and where to aim the bat 300. In some embodiments, the visual target 252 may provide a further visual reference for aiming the bat 300.

Alternatively or additionally, the cross-member 260 may provide a visual reference for the batter to stay clear of, and consequently, for the plurality of pads 212 (first and second pads 230 and 240, in this embodiment) to be impacted specifically by the "sweet spot" of the barrel 302, as shown. When the barrel 302 impacts the first and second pads 230, 240, part of the mechanical energy of the bat 300 is transferred to the first and second pads 230, 240, causing the cantilevered first and second pads 230, 240 to flex inward as pushed by the barrel 302. As the batter continues to progress with the swing, the first and second pads, as indicated by reference numerals 230' and 240', respectively, are sufficiently deformed to allow the barrel 302 to pass through and exit the swing assembly 112 at the opposite, rear side thereof, as indicated by reference numeral 302'. Once the barrel 302', has overcome the flexed first and second pads 230', 240', the elastically deformed pads return to their original position, indicated with reference numerals 230, 240, while the batter may finish the complete swing motion of the bat. After practicing swinging at the current position of the swing assembly 112, the training device 102 may easily be readjusted to different training positions of the swing assembly 112 to exercise the different swing mechanics required by each different training position. During the training session, the sensors 270, 272 and/or video cameras may collect information regarding the hitting and swinging action, as described heretofore, and transmit the information for visualization on a monitor, and/or for storage and/or processing.

In this way, the swing assembly 112 provides several advantageous effects. Firstly, different elements of the swing assembly 112, such as, but not limited to the open-ended bracket 210, pads 230, 240, slot 250, visual target 252 and/or cross-member 260, may provide clear visual references for the batter to rapidly and unconsciously aim and position the bat 300 with respect to the hitting target (i.e. the pads 230, 240). Secondly, the bracket 210 and support 110 do not interfere with the bat 300 when striking and swinging through the pads 230, 240, regardless of the position of the swing assembly 112. Additionally, when the barrel 302 initially impacts the pads 230, 240, a hitting sound and tactile impact is provided to the user, similarly to when hitting a real ball. In embodiments in which a visual target 252 harder than the pads 230, 240 is provided, the hitting sound may be particularly loud and better perceived by the batter. Furthermore, in embodiments in which the striking surface is provided by a single pair of pads 230, 240, the sound may more realistically mimic that of striking a real ball.

Further advantageous effects are provided by the fact that the pads 230, 240, when in the undeformed, rest position, are oriented generally perpendicular to the direction G of impact of the bat 300. On one hand, the wall-forming arrangement of the pads 230, 240 provides a visual reference for the user to bat flatly thereon, and thereby practice "barreling up" a real, thrown ball. In addition, should the bat 300 impact in an excessively oblique direction, the pads 230 and 240 will offer a greater resistance to flexing, which will dissuade the batter from impacting which excessive obliqueness and will remind the batter to hit flatly or substantially flatly on the pads 230, 240, to further train the batter to "barrel up" a real, thrown ball, or to hit with a controlledly higher launch angle. Furthermore, when swinging the bat 300 through the pads 230, 240, the elastically deformed pads 230, 240 (which tend to flex back to the rest position) force the bat to continue along its flat swinging direction (direction G in FIG. 6), further promoting correct swing mechanics.

A further advantage is that, after hitting the pads 230, 240, and in any orientation of the swing assembly 112, the user is able to complete the full swing, similarly to when hitting a real ball. Furthermore, a batter may carry out a series of consecutive swings without having to chase a ball or requiring help from another person. In addition, since the pads 230, 240 rapidly and automatically return to their original position after the swing, the batter is able to rapidly carry out multiple consecutive, uninterrupted swings, which provides enhanced training on rapid, unconscious and proper swinging mechanics for each specific position of the swing assembly 112. A further advantage is that pads 230, 240 having different resistances may be selectively mounted, in some embodiments, to vary the strength required to swing through the pads 230, 240 and thus adjust the difficulty level of the training session to meet the trainee's needs and goals.

Figure 7:
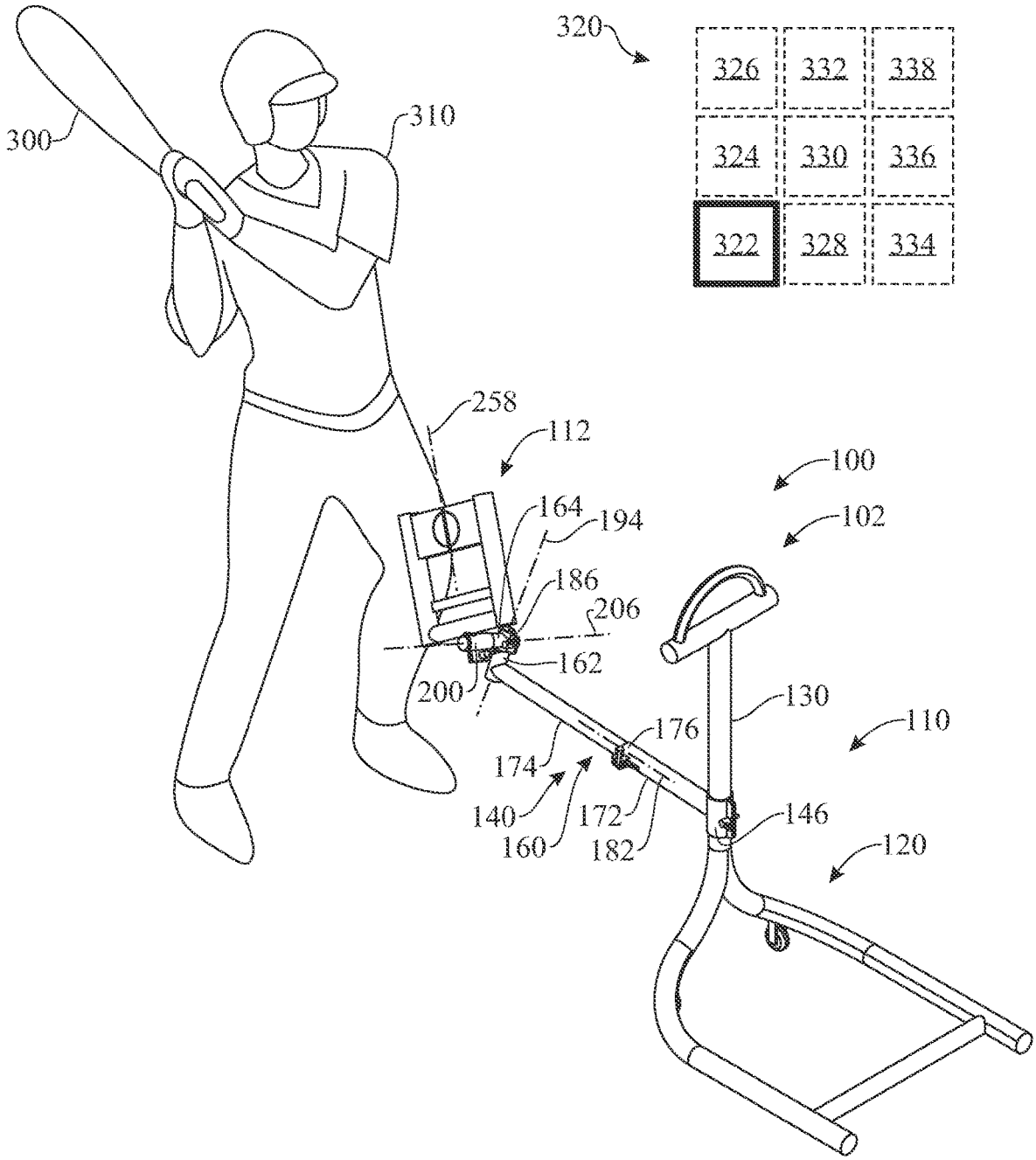
FIG. 7 presents the training device adjusted to practice swinging in a first quadrant of the striking zone.
Figure 8:
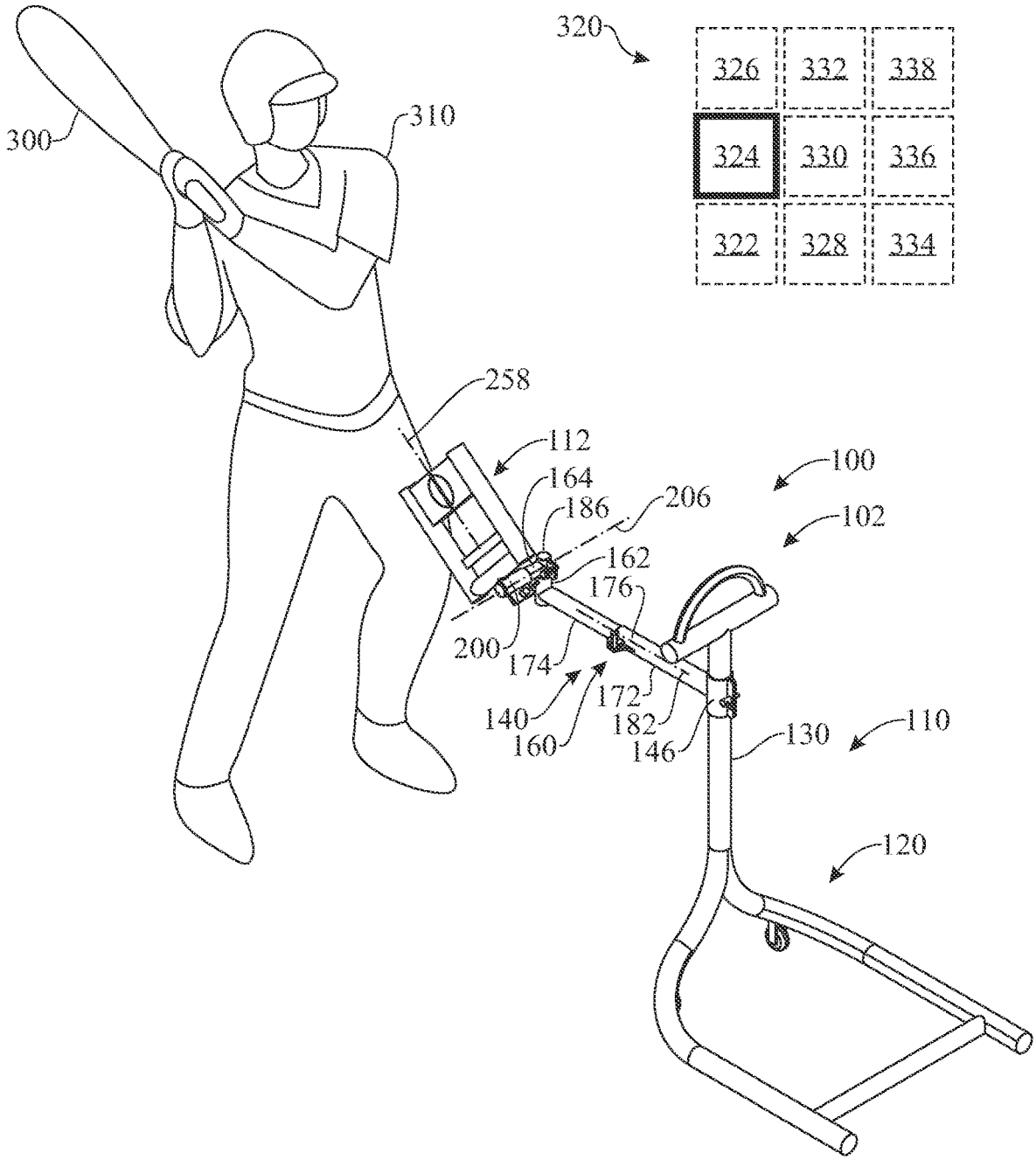
FIG. 8 presents the training device adjusted to practice swinging in a second quadrant of a striking zone.
Figure 9:
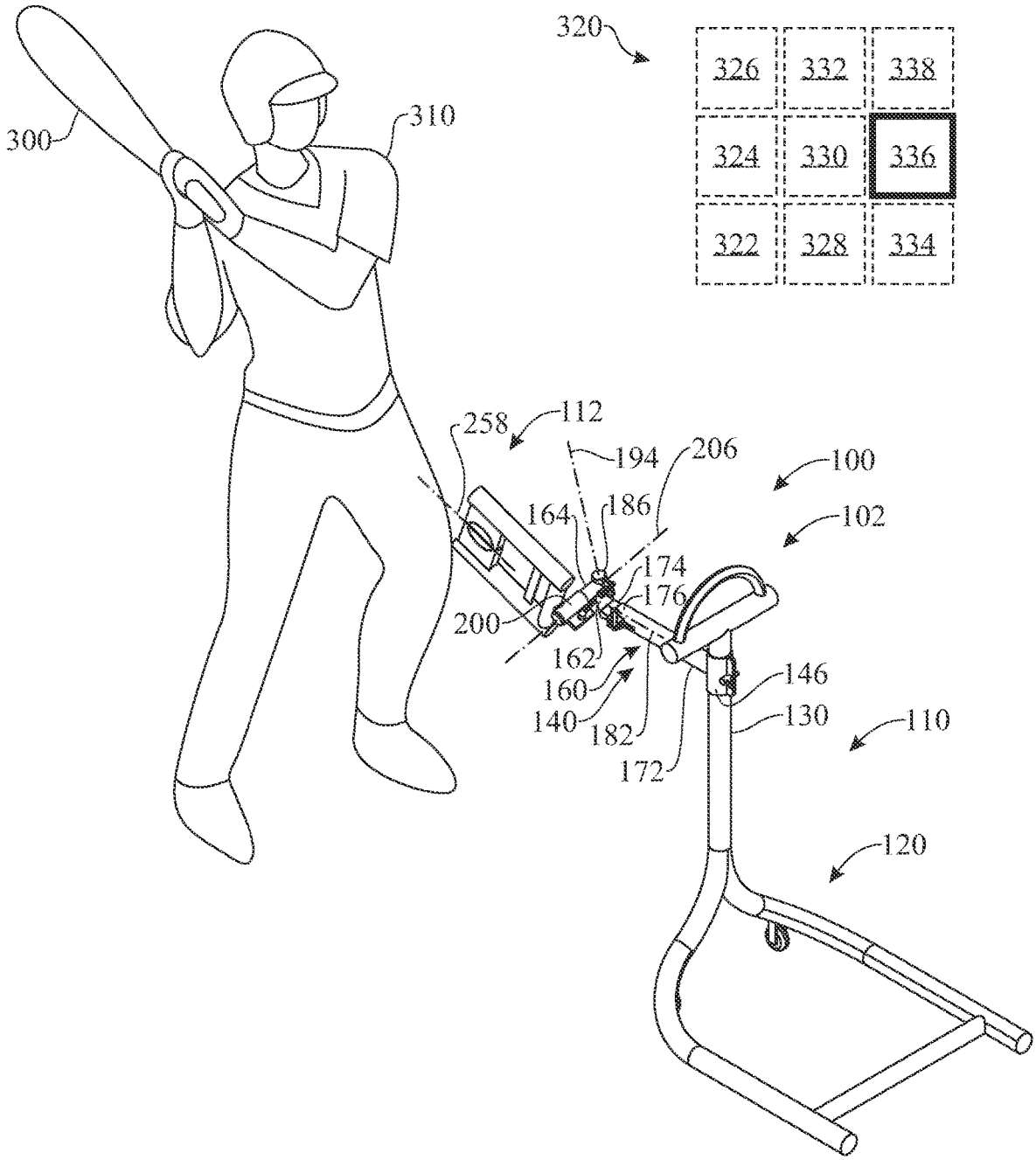
FIG. 9 presents the training device adjusted to practice swinging in an eighth quadrant of the striking zone.

The illustrations of FIGS. 7-11 show different examples of adjustments of the training device 102, to obtain different heights, angles, and orientations of the swing assembly 112 in order to practice a variety of swings. With reference initially to FIGS. 7-9, the training device 102 is shown adjusted to three different configurations allowing to practice swinging at balls thrown within three different, respective strike areas or quadrants of a batter's strike zone 320 (shown schematically on a top right corner of the figures). As known in the art, the strike zone 320 is the space through which a pitch must pass in order to be considered a strike if the batter does not swing. The strike zone 320 may be divided, for instance, into the following areas or quadrants: an inside and low, first quadrant 322; an inside, second quadrant 324; an inside and high, third quadrant 326; a middle and low, fourth quadrant 328; a middle, fifth quadrant 330; a middle and high, sixth quadrant 332; an outside and low, seventh quadrant 334; an outside, eight quadrant 336; an outside and high, ninth quadrant 338.

Batting in each quadrant typically requires a modification of swing mechanics or techniques. For example, when a ball is pitched to the batter into the first quadrant 322, the bat has to be swung more perpendicular or vertical in relation to the ground, as the batter's hands must never drop below the bat barrel. A swing in this first quadrant 322 is more similar to the swing plane of a golf swing (closer to vertical). It should be noted that the bat is rarely swung perfectly parallel; the hands are always desired to stay above the ball. On an inside pitch delivered into the second quadrant 324, the bat plane starts to level out and becomes more parallel to the ground as demonstrated in chart above. Continuing, as the bat goes into the third quadrant 326, the bat plane further levels out to an even lower angle relative to the ground. Throughout the movement from first quadrant 322, to second quadrant 324, and further to third quadrant 326, at the smallest of every increment of moving upward, the bat plane within each quadrant will have to adapt to match the pitch at is exact location. When looking at first, second and third quadrants 322, 324 and 326, the challenge for the batter is to create space. The ball being pitched inside offers little room, from the batter's hands to the torso; because of this, according to some theories, the batter needs to extend their hands out front, and also drop the bat head/barrel, also to create space because the batter will be twisting the "sweet spot" of the barrel closer to the batter's body. As the ball moves away from the batter, towards the outside pitches indicated at seventh, eighth, and ninth quadrants 334, 336, 338, the bat plane is not as severe and a less vertical plane swing is required, in comparison to, for instance, the first quadrant 322. Furthermore, inside pitches are hit out more in front of the batter; in order for the barrel to be able to get in proper position to line up with the ball, the hands and barrel have to clear the batter's body, if not the bat will hit the ball more on the handle, because the batter failed to get the barrel out front (such effect is referred to in baseball as getting "jammed on a pitch"). Outside pitches, in turn, are hit deeper in zone, and there is no need to clear the barrel from the body.

The training system 100 of the present invention allows to precisely set the swing assembly 112 at different quadrants, whether high or low, inside or outside. The illustration of FIG. 7, for instance, shows the training device 102 adjusted for the batter 310 to swing to the first quadrant 322. Specifically, the batter, coach or other user, has operated the first clamp 146 to lower the arm assembly 140 along the post 130 to a relatively low position. The second clamp 176 has been operated to adjust the length of the first segment 160 of the arm assembly 140 to a relatively long or extended configuration, and to rotate the second portion 174 of the first segment 160 slightly rearward about rotation axis 182 relative to the first portion 172. The fourth clamp 200 has been operated to pivot the swing assembly 112 to a first angular position relative to rotation axis 206 such that the C-shaped bracket 210 points upward, almost vertically, and the slot plane 258 forms a relatively large, yet acute angle with a horizontal plane. The slot plane 258, as adjusted, corresponds to the desired orientation of the bat 300 when swinging in the first quadrant 322. In some embodiments, the user may have easily positioned the different clamps and associated slidable/rotational elements to the position of FIG. 7 by operating said clamps and elements to a visual marking associated to the first quadrant 322 (e.g., "Q1").

The illustration of FIG. 8 shows the training device 102 adjusted for a batter 310 to swing to the second quadrant 324. Relative to the position of FIG. 7, the batter, coach or other user has operated the first clamp 146 and adjusted the arm assembly 140 along the post 130 to a relatively higher position. The second clamp 176 has been operated to slightly compress the first segment 160 of the arm assembly 140 to a slightly shorter length, relative to that of FIG. 7. The fourth clamp 200 has then been operated to pivot the swing assembly 112 to a second, angular position relative to rotation axis 206 such that the slot plane 258 forms a relatively smaller (with respect to that of FIG. 7), yet acute angle with a horizontal plane. The slot plane 258, as adjusted, corresponds to the desired orientation of the bat 300 when swinging in the second quadrant 324. In some embodiments, the user may have easily positioned the different clamps and associated slidable/rotational elements to the position of FIG. 8 by operating said clamps and elements to a visual marking associated to the second quadrant 324 (e.g., "Q2").

The illustration of FIG. 9, in turn, shows the training device 102 adjusted for the batter 310 to swing to the eighth quadrant 336. Relative to the position of FIG. 8, the batter, coach or other user has operated the first clamp 146 and adjusted the arm assembly 140 along the post 130 to a relatively higher position. The second clamp 176 has been operated to further compress the first segment 160 of the arm assembly 140 to an even shorter length and to rotate the second portion 174 of the first segment 160 slightly forward about rotation axis 182 relative to the first portion 172, with respect to the position of FIG. 8. The fourth clamp 200 has been operated to pivot the swing assembly 112 to a lower, third angular position relative to rotation axis 206 such that the slot plane 258 forms a smaller, acute angle with a horizontal plane, with respect to the position of FIG. 8, the slot plane 258 corresponding to the desired orientation of the bat 300 when swinging in the eighth quadrant 336. In some embodiments, the user may have easily positioned the different clamps and associated slidable/rotational elements to the position of FIG. 9 by operating said clamps and elements to a visual marking associated to the eighth quadrant 336 (e.g., "Q8"). Repetitive swinging in each of the adjustment configurations of FIGS. 7-9, facilitated by the elastic, plurality of pads 212, allows the user to develop unconscious and rapid swing mechanics for each respective quadrant within the striking zone 320.

Figure 10:
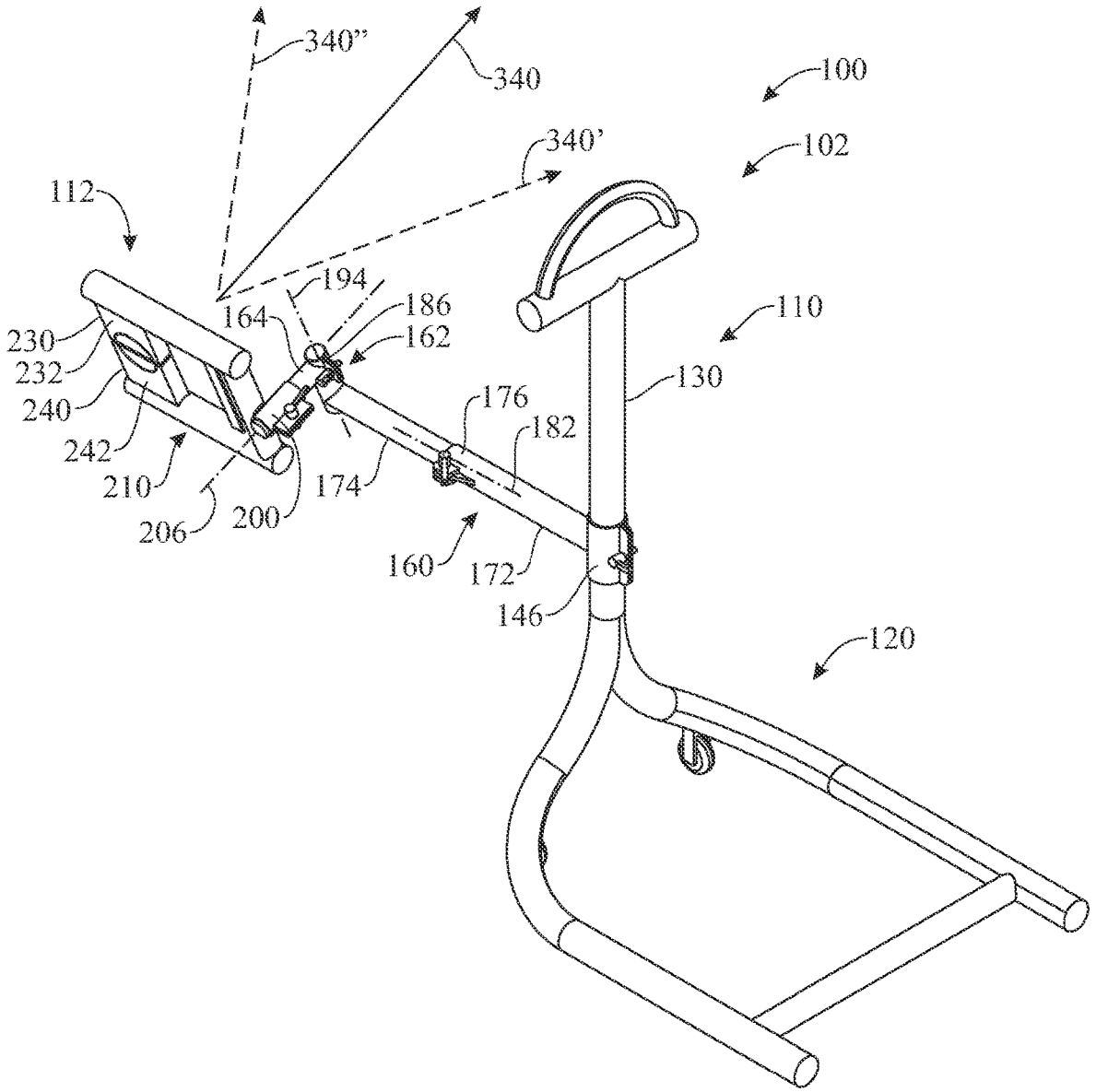
FIG. 10 presents the training device adjusted to practice swinging with a relatively larger launch angle and/or "barreling up" a downward pitched ball.
Figure 11:
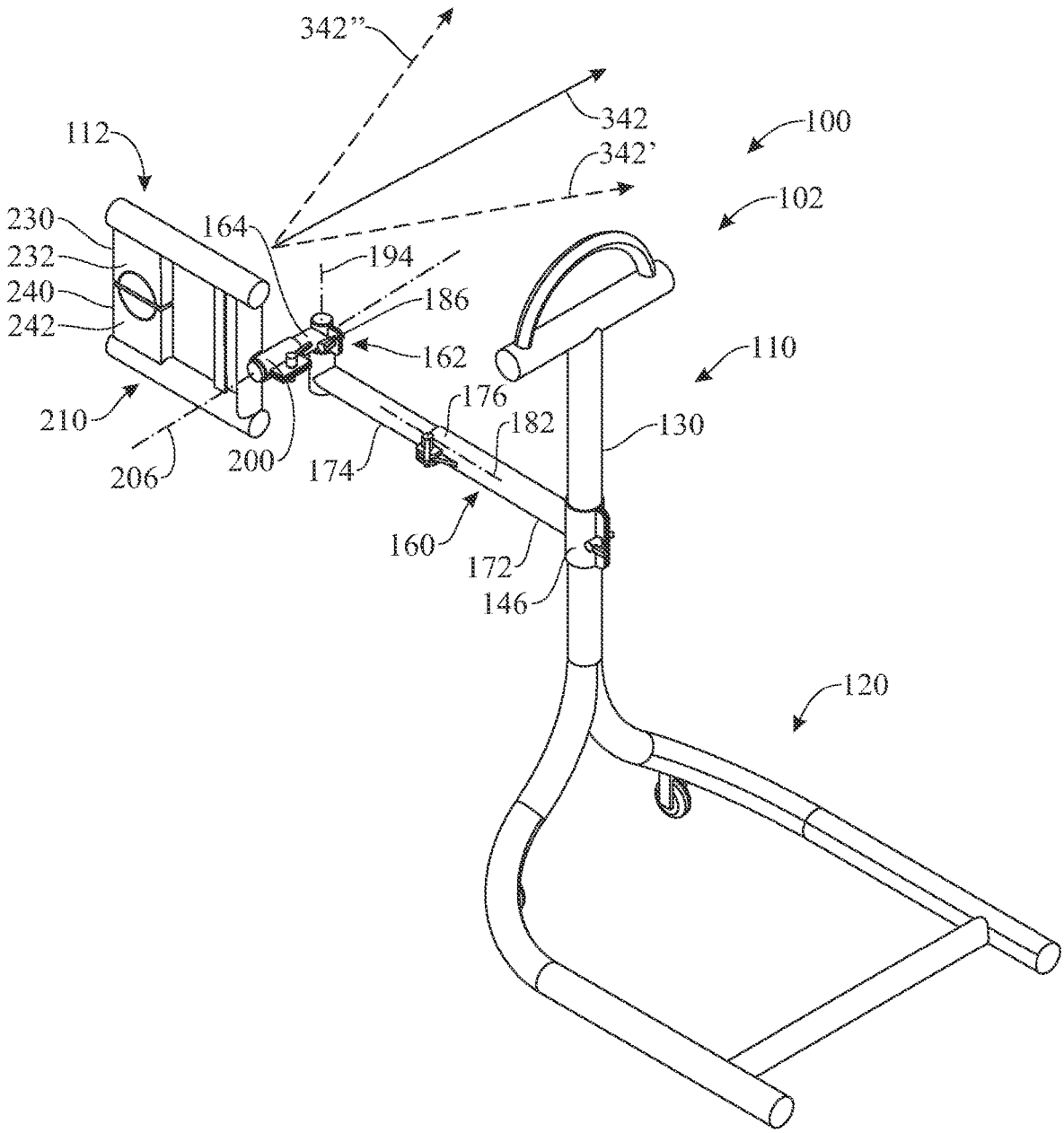
FIG. 11 presents the training device adjusted to practice swinging with a relatively smaller launch angle and/or "barreling up" a more horizontally pitched ball.

Turning to FIGS. 10 and 11, the training device 102 is further shown adjusted to train different exemplary launch angles. Specifically, as shown in FIG. 10, the training device 102 may be adjusted operating the second clamp 176 and pivoting the second portion 174 of the first segment 160 of the arm assembly 140 forward, about rotation axis 182, so that the swing assembly 112, and more specifically, the striking surface provided by the first sides 232 and 242 of the first and second pads 230 and 240 is pivoted towards the ground. This forward-tilted position of the pads 230, 240 allows the user to practice swinging in a relatively upward-sloped, relatively straight direction 340, which may promote swinging mechanics associated to batting towards center field, with a relatively large launch angle and/or barreling a downward pitched ball. The user may further adjust the training device 102 by operating the third clamp 186 and rotating the third segment 164 relative to the second segment 162 about rotation axis 194 to pivot the swing assembly 112 clockwise or counterclockwise, to practice hitting in directions 340' and 340", associated with batting towards right field or left field, respectively. It should be noted that similar center field, left field and right field adjustment variations are possible in the configurations of FIGS. 7-9.

The illustration of FIG. 11, instead, shows the swing assembly 112 of the training device 102 adjusted to a more vertical position (relative to FIG. 1) by operating the second clamp 176 and pivoting the second portion 174 of the first segment 160 of the arm assembly 140 rearward, about rotation axis 182. In this new adjustment, the striking surface provided by the first sides 232 and 242 of the first and second pads 230 and 240 is more vertically oriented relative to FIG. 10, and thus allows the user to practice swinging in straight, slightly upward-sloped direction 342, which is less sloped relative to direction 340 of FIG. 10. This new adjustment of FIG. 10, associated to direction 342, may promote swinging mechanics for batting towards center field, with a relatively lower launch angle and/or barreling a more horizontally pitched ball relative to FIG. 10. As with the previous figure, the user may further adjust the training device 102 by operating the third clamp 186 and rotating the third segment 164 relative to the second segment 162 about rotation axis 194 to pivot the swing assembly 112 clockwise or counterclockwise, to practice hitting in directions 342' and 342", associated with batting towards right field or left field, respectively.

In a further adjustment, a user may select to rotate the arm assembly 140 at rotation axis 182 to flip the swing assembly 112 vertically, allowing the training device 100 to selectively accommodate a left- or right-handed swinger with little adjustment. Alternatively, left-handed and right-handed adjustment may be achieved by detaching the arm assembly 140 from the post 130 (for which the handle 138 may be disconnectably removable from the post 130, for instance and without limitation), flipping the arm assembly 140 over vertically, and mounting the arm assembly 140 in this inverted position on the post 130. In other embodiments, other sections of the arm assembly 140 may be detached from one another and mounted to one another in an inverted position to achieve a similar result.

It should be noted that all adjustments and adjustment examples described herein may be used in combination with each other in different applications or methods of operation of the training system 100.

In summary, the disclosed training system maximizes power development, and can replicate a pitch in all zone/quadrants of the strike zone, while also enabling customization at any plane/axis, angle, and combinations thereof. These multiple customizations, adjustments, and effects may be practiced simultaneously, producing the most life-like feel. In addition, by being able to impact the device but also swing through the device, the batter is taught to swing in a spherical pattern; as the batter is trained to move within and to all quadrants, the batter's swing sphere changes to accommodate the pitch location. In this way, each batter is best served by developing and practicing swings at all pitch locations. Because pitches are delivered in all areas of the strike zone, the batter develops swing mechanics that are dynamic enough to adapt to every location. Instead of training a single swing, the batter is able to develop multiple swing patterns to become the most complete hitter.

As previously stated and more so, the apparatus simultaneously addresses different attack angles (where to strike the ball and on what plane), launch angles (ascend to descend, ground ball through line drive to fly ball), horizontal angles (from left field through right field to ensure placement and control to hit a fair ball), and striking zone/quadrants (height and spatial distance to the batter), developing the player's ability to hit the ball to all fields based upon where the ball is pitched. By coaching to hit the ball where it is pitched, the training device offers the greatest chance of physics to work in the batter's favor to deliver the ball with the most economical athletic movement in return for the greatest energy force.

The quick adjustment of the apparatus to the slightest degree not only helps reinforce patterns but also provides a visual aid (visual learning) to the batter, which then translates to the batter's body moving in order to swing with the most effective path towards the ball. There is no thinking; instead, the batter's body (swing) must adapt to the parameters in which the training device has been preset, to ensure the proper swing, all while keeping the swing relevant to the field of play. Moreover, the training device facilitates developing muscle memory for multiple swing patterns, simulating selected ball resistances (which may be life-like, or greater or less than real life ball resistances, in dependence of training goals), with no concern of collecting batted balls or reloading.

The apparatus may include markings, which may be provided in degrees or other units, symbols, or indications, and may facilitate adjusting/adapting the swing in its natural relationship to the geometry of the field of play. This will further advance not only batters' ability but also coaches' ability to quantify each batter's swing to their own make-up so to have the most complete data to work from. As known, baseball is prone to complex analytics, and being able to keep percentages and various metrics greatly helps to gain further advantage in the training process. Collecting data and obtaining mathematical analytics can be used to evaluate a player, and may help develop offensive and/or defensive play strategies.

Teaching hitting has many nuances within its framework There are many reason why it is advantageous to have customizability of all the planes/axis and angles within each quadrant. The purpose of striking the ball in practice or game situation is not always to produce the same results. Game situations could dictate a player hitting a ball at a different attack angle and or launch angle. Exaggeration drills may be carried out during practice to help enforce proper mechanics. Furthermore, there are many coaches and hitters who differ in opinion on how to use launch angle or attack angle, and have their personal opinions on how to interpret, compensate and adjust. The training system/apparatus of the present disclosure is adaptable to various coaching styles while providing a fundamental structure promoting proper technique for all to value and build on, offering an abundance of dynamic interpretations.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A ball swing training system comprising:

a ball swing training device, including a support assembly and a swing assembly carried by the support assembly; wherein the swing assembly comprises:

a bracket, having a first member and a second member arranged in spaced-apart relationship with one another, the bracket further comprising an open, first end defined between respective ends of the first and second members, wherein a second end of the bracket opposite the first end is connected to the support assembly, at least one pair of resistance pads, said at least one pair of resistance pads comprising elastically deformable, first and second pads mountable to the first and second members of the bracket, respectively, wherein the first and second pads when mounted on the first and second members are elastically biased to a rest position in which the first and second pads are oriented towards one another with respective front sides of the first and second pads providing a striking surface, and wherein the first and second pads when mounted on the first and second members are elastically deformable from said rest position by a hand-operated bat impacting the striking surface and are configured to absorb part of a mechanical energy of said bat when said bat impacts the striking surface and to deform away from one another allowing said bat to pass through the first and second pads; and further wherein the support assembly is adjustable for repositioning the swing assembly along one or more directions; wherein the bracket further comprises a cross-member, wherein the cross-member is more flexible than the at least one pair of resistance pads, and further wherein the cross-member is mountable from the first member to the second member and in spaced-apart relationship and generally parallel to the first and second pads in the rest position.

2. The ball swing training system of claim 1, wherein the support assembly comprises an arm assembly attachable to a structure, the arm assembly selectively movable relative to the structure for repositioning the swing assembly.

3. The ball swing training system of claim 2, wherein the support assembly further comprises a post providing said structure.

4. The ball swing training system of claim 3, wherein the arm assembly is slidably attachable to the post.

5. The ball swing training system of claim 3, wherein the support assembly further comprises a base carrying the post, the base configured to rest on a ground or surface.

6. The ball swing training system of claim 2, wherein the arm assembly is length-adjustable.

7. The ball swing training system of claim 6, wherein the arm assembly comprises a length-adjustable, first segment.

8. The ball swing training system of claim 7, wherein the length-adjustable first segment comprises elongate first and second portions telescopically connected to one another and selectively rotatable relative to one another.

9. The ball swing training system of claim 8, wherein the arm assembly comprises a second segment and a third segment, the first, second and third segments generally rigid and straight, wherein the second segment is carried by and extends perpendicularly from the first segment, and further wherein the third segment is carried by and extends perpendicularly from the second segment and is pivotably connected to the second segment about a rotation axis coaxial with the second segment.

10. The ball swing training system of claim 9, wherein the third segment is pivotably connected to the swing assembly about a rotation axis arranged coaxial with the third segment.

11. The ball swing training system of claim 1, wherein the bracket further comprises a connecting member extending between and interconnecting the first member and the second member, wherein the connecting member, first member and second member form a rigid C-shape, an open end of the C-shape providing the open, first end of the bracket.

12. The ball swing training system of claim 1, wherein each one of the first and second pads of said at least one pair of resistance pads comprises a respective visual target portion, and further wherein, in the rest position of the first and second pads, the visual target portions of the first and second pads jointly provide a visible target on the striking surface.

13. The ball swinging training system of claim 12, wherein the respective visual target portion of each one of the first and second pads is more resistant to deformation than a remainder of said each one of the first and second pads.

14. The ball swinging training system of claim 12, wherein the respective visual targets are two-dimensional.

15. The ball swinging training system of claim 12, wherein the respective visual targets are three-dimensional.

16. The ball swing training system of claim 12, wherein the visible target is shaped as a ball.

17. The ball swing training system of claim 1, wherein the at least one pair of resistance pads is disconnectably mountable to the first and second members of the bracket.

18. The ball swing training system of claim 17, wherein the at least one pair of resistance pads comprises a plurality of pairs of resistance pads selectively and interchangeably mountable to the bracket, each pair of resistance pads of the plurality of pairs of resistance pads having a different resistance to deformation.

19. The ball swing training system of claim 1, further comprising one or more sensors carried by the first and second pads and configured to measure an impact speed or force on the pads and provide information related to said measurement to a control unit.

20. A ball swing training system comprising:

a ball swing training device, including a support assembly and a swing assembly carried by the support assembly; wherein the swing assembly comprises:

a bracket, having a first member and a second member arranged in spaced-apart relationship with one another, the bracket further comprising a connecting member extending between and interconnecting the first member and the second member, wherein the connecting member, first member and second member form a rigid C-shape, wherein the connecting member is arranged opposite to an open end of the C-shape and is connected to the support assembly, at least one pair of resistance pads, said at least one pair of resistance pads comprising elastically deformable, first and second pads mountable to the first and second members of the bracket, respectively, wherein the first and second pads when mounted on the first and second members are elastically biased to a rest position in which the first and second pads are oriented towards one another with respective front sides of the first and second pads providing a striking surface, and wherein the first and second pads when mounted on the first and second members are elastically deformable from said rest position by a hand-operated bat impacting the striking surface and are configured to absorb part of a mechanical energy of said bat when said bat impacts the striking surface and to deform away from one another allowing said bat to pass through the first and second pads, and a cross-member, wherein the cross-member is more flexible than the at least one pair of resistance pads, and further wherein the cross-member is mountable from the first member to the second member, between connecting member and the first and second pads in the rest position, and in spaced-apart relationship and generally parallel to the first and second pads in the rest position; and further wherein the support assembly is adjustable for repositioning the swing assembly along one or more directions.

21. A ball swing training system comprising:

a ball swing training device, including a support assembly and a swing assembly carried by the support assembly; wherein the swing assembly comprises:

a bracket, having a first member and a second member arranged in spaced-apart relationship with one another, the bracket further comprising a connecting member extending between and interconnecting the first member and the second member, wherein the connecting member, first member and second member form a rigid C-shape, wherein the connecting member is arranged opposite to an open end of the C-shape and is connected to the support assembly, at least one pair of resistance pads, said at least one pair of resistance pads comprising elastically deformable, first and second pads mountable to the first and second members of the bracket, respectively, the first and second pads comprising a respective visual target portion, wherein the first and second pads when mounted on the first and second members are elastically biased to a rest position in which the first and second pads are oriented towards one another with respective front sides of the first and second pads providing a striking surface and with the visual target portions jointly providing a visible target on the striking surface, and wherein the first and second pads when mounted on the first and second members are elastically deformable from said rest position by a hand-operated bat impacting the striking surface and are configured to absorb part of a mechanical energy of said bat when said bat impacts the striking surface and to deform away from one another allowing said bat to pass through the first and second pads, a cross-member, wherein the cross-member is more flexible than the at least one pair of resistance pads, and further wherein the cross-member is mountable from the first member to the second member, between connecting member and the first and second pads in the rest position, and in spaced-apart relationship and generally parallel to the first and second pads in the rest position; and further wherein the support assembly is adjustable for repositioning the swing assembly along one or more directions.

* * * * *